United States Patent [19]

Burchette, Jr.

[11] Patent Number: 4,760,976

[45] Date of Patent: Aug. 2, 1988

[54] TRANSFER TAIL RECEIVING STRUCTURE FOR A YARN CARRIER

[76] Inventor: Robert L. Burchette, Jr., P.O. Box 188, Spartanburg, S.C. 29304

[21] Appl. No.: 138,296

[22] Filed: Dec. 28, 1987

[51] Int. Cl.[4] ..... B65H 75/18

[52] U.S. Cl. ..... 242/118.11; 242/18 PW; 242/118.3; 242/125.1; 242/165

[58] Field of Search ..... 242/118.11, 118.1, 118.2, 242/118.3, 118.31, 118.32, 125, 125.1, 125.2, 125.3, 164, 165, 166, 167, 159, 18 PW; 68/189, 198

[56] References Cited

U.S. PATENT DOCUMENTS

| | | | |
|---|---|---|---|
| 3,827,652 | 8/1974 | Burchette, Jr. | 242/118.11 |
| 4,050,645 | 9/1977 | Burchette, Jr. et al. | 242/125.1 |
| 4,050,646 | 9/1977 | Burchette, Jr. | 242/125.1 |
| 4,181,274 | 1/1980 | Burchette, Jr. | 242/118.11 |
| 4,659,032 | 4/1987 | Rottleb | 242/125.1 X |
| 4,702,433 | 10/1987 | Gilljam et al. | 242/118.11 X |

*Primary Examiner*—Stanley N. Gilreath
*Attorney, Agent, or Firm*—Dority & Manning

[57] ABSTRACT

In a collapsible polymeric yarn carrier having at least one end flange, a transfer tail receiving structure comprises a groove formed in the end flange for receiving the windings of the transfer tail, a thin protective layer of material overlying and covering the groove, a cut or overlapping seam in the layer of material overlying the groove to allow a transfer tail winding to pass through the material and be wound in the groove, and a pair of boundary surfaces on the flange on each side of the groove and containing an annular ridge in each boundary surface to facilitate securing the layer of material in place over the groove.

20 Claims, 1 Drawing Sheet

TRANSFER TAIL RECEIVING STRUCTURE FOR A YARN CARRIER

BACKGROUND OF THE INVENTION

This invention relates to a core onto which textile yarn is wound for dyeing, and in particular a transfer tail receiving structure for such yarn carrying device.

A core structure onto which textile yarn is wound for dyeing is known by several names, including, dye spring, dye tube and yarn carrier. Such structures are generally cylindrical in shape and can be formed of stainless steel or a plastic composition. The carriers commonly have an annular flange at each end and an intermediate structure located between the annular flanges comprising either a plurality of rings separated by a predetermined pattern of alternating collapsible and rigid axial members or one or more helical elements separated by a predetermined pattern of alternating collapsible and rigid members. Filter paper, a knitted sock or some other thin layer of material is commonly wrapped around the carrier before the yarn is wound thereon, particularly when a quality dyeing operation is to be achieved.

Three examples of yarn carriers invented by the present applicant are disclosed in U.S. Pat. Nos. 3,827,652, 4,050,646 and 4,181,274, which are hereby incorporated herein by reference. Referring to U.S. Pat. No. 4,181,274, there is disclosed a transfer tail receiving groove 341 located at an end of a dye tube 310 for receiving a yarn transfer tail. However, the transfer tail may become damaged during processing of the yarn after winding around the tube. Such damage can render the transfer tail useless for its intended purpose, thereby requiring considerable human and machine effort to remedy the damage. Thus, it is important to maintain the integrity of the transfer tail until such time as it is required.

OBJECTS AND SUMMARY OF THE INVENTION

It is an object of the present invention to provide a yarn carrier having an improved transfer tail receiving structure.

Another object of the present invention is to provide a transfer tail receiving structure that ensures the availability of the transfer tail subsequent to the dyeing of the yarn wound on the yarn carrier.

A further object of the present invention is to provide a collapsible polymeric dye tube having an improved transfer tail receiving structure that maintains the integrity of the transfer tail during processing of the yarn wound around the dye tube.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the transfer tail receiving structure of this invention comprises means for receiving the windings of the transfer tail, the receiving means being formed in an end flange of a yarn carrier; means for covering the receiving means; and entry means for allowing each winding of the transfer tail to pass through the cover means and be wound in the receiving means. The transfer tail receiving structure of the invention also can include means for securing the cover means to the end flange. The receiving means can comprise an annular transfer tail receiving groove, and the covering means can comprise a thin layer of material, such as a strip of filter paper or polymeric film, which overlies the receiving groove. The entry means can comprise a cut through the thin layer of material or the overlapping portion of a pair of strips of material which overlap in the region covering the transfer tail receiving groove. The securing means can comprise a portion of the boundary surface of the end flange and can include a pair of parallel annular ridges formed on the portion of the boundary surface of the end flange of the yarn carrier, the transfer tail receiving groove being located between the pair of parallel annular ridges.

BRIEF DESCRIPTION OF THE DRAWINGS

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENT

Reference now will be made in detail to the present preferred embodiments of the invention, examples of which are illustrated in the accompanying drawings.

Figure 1:
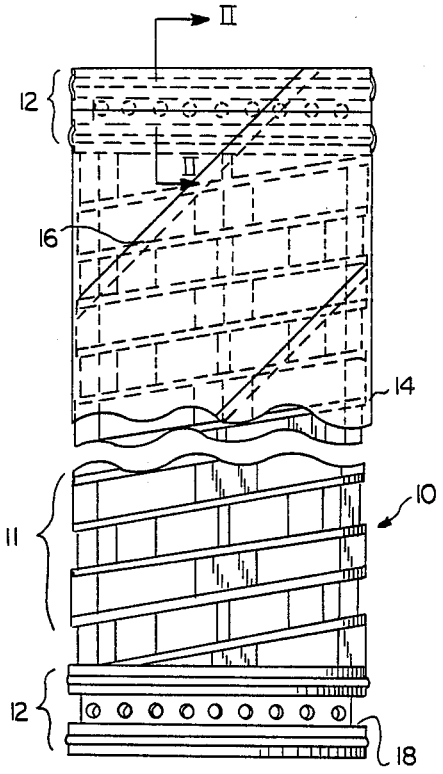
FIG. 1 is a side plan view of an embodiment of the present invention.
Figure 2:
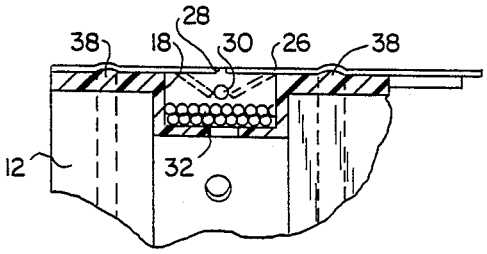
FIG. 2 is a vertical section of a first embodiment of the invention taken along the view II—II of FIG. 1.
Figure 4:
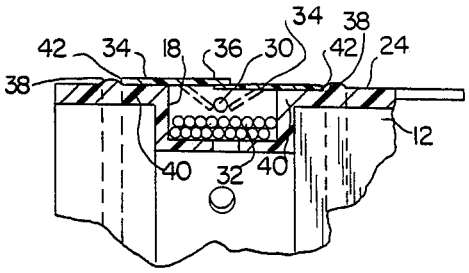
FIG. 4 is a vertical section of a second embodiment of the invention taken along the view II—II of FIG. 1.

The preferred embodiments of the transfer tail receiving structure are shown in FIGS. 1, 2 and 4. A cylindrical yarn carrier is indicated generally by the numeral 10 in FIG. 1. Carrier 10 is preferably a collapsible polymeric dye tube such as shown for example in each of applicant's U.S. Pat. Nos. 3,827,652, 4,050,646 and 4,181,274. Carrier 10 has an intermediate network 11 that is collapsible under an axially directed force of some predetermined threshold magnitude. Carrier 10 has an annular end flange 12 on each end of the intermediate network and is covered with a narrow sheet 14 of material, such as filter paper or a film of a polymeric nature, that is wrapped around carrier 10 in a helical fashion. As shown in FIG. 1, the helical wrapping results in the formation of a narrow overlapping seam 16 on the edges of the material.

Figure 3:
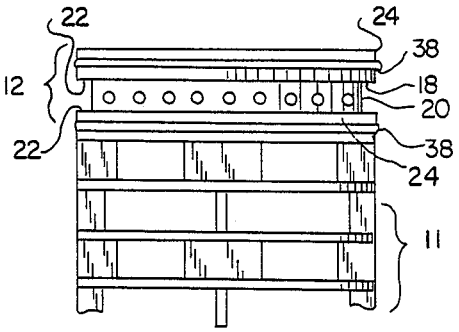
FIG. 3 shows an end flange formed according to one embodiment of the present invention.

In accordance with the present invention, the transfer tail receiving structure in a yarn carrier having an end flange comprises means for receiving the windings of the transfer tail, said receiving means being formed in the end flange. As embodied herein and shown specifically in FIGS. 1–4 for example, the transfer tail receiving means is an annular groove 18 formed in annular end flange 12. As shown in FIG. 3 for example, groove 18 extends completely around end flange 12 and includes a bottom portion 20 and a pair of side wall portions 22 integrally formed with bottom 20. An annular boundary surface 24 is formed in end flange 12 on each side of groove 18. Each side wall portion 22 integrally joins with a respective annular boundary surface 24 of end flange 12 on each side of groove 18.

In accordance with the present invention, there is provided means for covering the transfer tail receiving means. As embodied herein, and shown in FIG. 2 for example, the covering means includes a thin protective layer 26 of material overlying groove 18 and extending to overlie at least a portion of boundary surfaces 24 on each side of groove 18. The protective layer of material can be fabricated of filter paper, plastic film, cellulosic based sheet material or other suitable material of a polymeric nature that can be formed in a thin layer on the order of a few thousandths of an inch, i.e., a few mils thick, and that possesses sufficient resilience to perform the function described below. As shown in FIG. 1, the portion of the sleeve of filter paper, or other such material that is wrapped around carrier 10, extending over end flanges 12 can be used as the covering means in one preferred embodiment of the present invention.

In a second preferred embodiment of the invention, shown for example in FIG. 4, the covering means of the invention comprises a pair of thin overlapping annular strips 34 of material. Overlapping portions 36 of strips 34 overlie groove 18 generally in the central region thereof. Strips 34 can be fabricated of filter paper, plastic film, cellulosic based sheet material or other suitable material of a polymeric nature that can be formed in a thin strip on the order of a few mils thickness and that possesses sufficient resilience to perform the function described hereinafter.

In accordance with the present invention, there is provided entry means for allowing each strand of yarn of the transfer tail to pass through the cover means and be wound in the receiving means. As embodied herein and shown for example in FIG. 2, a first preferred embodiment of the entry means comprises a cut 28 through the covering means that permits deflection of the covering means inwardly towards groove 18 as each strand 30 of yarn of transfer tail 32 passes through cut 28 to be wound in groove 18. Cut 28 preferably is smaller than the cross sectional diameter of each winding 30 of the transfer tail such that the covering means must deflect inwardly to allow passage of the winding past the covering means. The resilience of the material comprising the covering means causes the covering means to resume its undeflected position after passage of each winding 30 into groove 18. The resilience of the material comprising the covering means causes the covering means to resume its undeflected position after passage of each winding 30 into groove 18.

A second preferred embodiment of the entry means of the present invention is shown in FIG. 4 for example, and comprises the overlapping portions 36 of a pair of annular strips 34 of material which overlap in the region overlying groove 18. Strips 34 are free to deflect inwardly to allow passage of each transfer tail winding 30 as the winding is wound around groove 18. The resilience of the material comprising the covering means causes the covering means to resume its undeflected position after passage of each widing 30 into groove 18.

In still further accordance with the present invention, there is provided means for securing the cover means to the end flange of the yarn carrier. As embodied herein and shown for example in FIGS. 1 and 2, a first embodiment of the securing means comprises a pair of parallel annular ridges 38 formed integrally on each end flange 12 of yarn carrier 10, and specifically on each boundary surface 24 thereof. Transfer tail receiving groove 18 is located between the pair of parallel annular ridges. Protective layer 26 can be secured to end flange 12 by heat-sealing layer 26 to each ridge 38 prior to formation of cut 28. In a second preferred embodiment of the securing means of the present invention, as shown for example in FIG. 4, each strip 34 of the pair of overlapping annular strips of the protective layer of material can be heat-sealed to a portion 40 of each boundary surface 24 nearest groove 18. The edge 42 of each strip 34 farthest from groove 18 can butt against ridge 38 formed on boundary surface 24 of end flange 12.

It will be apparent to those skilled in the art that various modifications and variations can be made in the transfer tail receiving structure of the present invention without departing from the scope or spirit of the invention. Thus, it is intended that the present invention cover the modifications and variations of this invention provided they come within the scope of the appended claims and their equivalents.

What is claimed is:

1. A transfer tail receiving structure in a yarn carrier having an end flange, the transfer tail receiving structure comprising:

means for receiving the windings of the transfer tail, said receiving means being formed in the end flange;

means for covering said receiving means; and entry means for allowing each winding of a transfer tail to pass through said cover means and be wound in said receiving means.

2. A transfer tail receiving structure as in claim 1, also including means for securing said cover means to the end flange.

3. A transfer tail receiving structure as in claim 1 wherein said receiving means comprises an annular transfer tail receiving groove.

4. A transfer tail receiving structure as in claim 1 wherein said covering means comprises a thin protective layer of material.

5. A transfer tail receiving structure as in claim 2 wherein said securing means comprises a pair of parallel annular ridges formed on the end flange of the yarn carrier, said transfer tail receiving means being located between said pair of parallel annular ridges.

6. A transfer tail receiving structure as in claim 4 wherein said entry means comprises a cut in said protective layer of material.

7. A transfer tail receiving structure as in claim 6 wherein the diameter of said cut is smaller than the diameter of the yarn strand forming the transfer tail winding, and said layer of material deflects inwardly towards said receiving means to allow passage of each transfer tail yarn strand past said covering means to be wound in said receiving means.

8. A transfer tail receiving structure as in claim 7 wherein said covering means comprises a thin protective layer of material.

9. A transfer tail receiving structure as in claim 8 wherein said entry means comprises a cut in said protective layer of material.

10. A transfer tail receiving structure as in claim 9 wherein said securing means comprises a pair of parallel annular ridges formed on the end flange of the yarn carrier, said transfer tail receiving groove being located between said pair of parallel annular ridges.

11. A transfer tail receiving structure as in claim 1 wherein said covering means comprises a pair of strips of thin material which overlap in the region overlying said transfer tail receiving means.

12. A transfer tail receiving structure as in claim 11 wherein said thin material comprises a material selected from one of the following: filter paper, plastic film, cellulosic based material and polymeric based material.

13. A transfer tail receiving structure as in claim 11 wherein said entry means comprises the overlapping portions of said strips, said strips having sufficient resilience to deflect inwardly toward said receiving means to allow passage of the yarn strand of the transfer tail past said overlapping portions and thereafter return to the undeflected position.

14. A transfer tail receiving structure in a yarn carrier having an end flange, the transfer tail receiving structure comprising:

a pair of parallel annular ridges formed on the end flange of the yarn carrier;

an annular groove formed in the flange and between said ridges, said groove being for receiving the windings of a transfer tail;

means for covering said groove; and entry means for allowing each strand of yarn of the transfer tail to pass through said covering means and be wound around said groove.

15. A transfer tail receiving structure as in claim 14 wherein said covering means comprises a thin layer of material.

16. A transfer tail receiving structure as in claim 15 wherein said entry means comprises a cut in said layer of material.

17. A transfer tail receiving structure as in claim 14 wherein said covering means comprises a pair of strips of thin material which overlap in the region overlying said annular groove.

18. A transfer tail receiving structure as in claim 15 wherein said thin material comprises a material selected from one of the following: filter paper, plastic film, cellulosic based material and polymeric based material.

19. A transfer tail receiving structure as in claim 17 wherein said entry means comprises the overlapping portions of said strips.

20. A transfer tail receiving structure in a collapsible polymeric yarn carrier having an intermediate network that is collapsible under an axially directed force and an end flange at each end of the intermediate network, the transfer tail receiving structure comprising:

an annular groove formed in at least one end flange for receiving the windings of the transfer tail;

means for covering said groove; and entry means for allowing each winding of the transfer tail to pass through said covering means and be wound in said groove.

* * * * *